US005779162A

United States Patent [19]

Noakes et al.

[11] Patent Number: 5,779,162

[45] Date of Patent: Jul. 14, 1998

[54] SPRAYING DEVICE

[75] Inventors: Timothy James Noakes, Pantymwyn; Michael Leslie Green, Nannerch; Maurice Joseph Prendergast, Runcorn; Andrew Jefferies, Pantymwyn, all of United Kingdom

[73] Assignee: Imperial Chemical Industries PLC, London, United Kingdom

[21] Appl. No.: 646,247

[22] PCT Filed: Nov. 2, 1994

[86] PCT No.: PCT/GB94/02407

§ 371 Date: May 14, 1996

§ 102(e) Date: May 14, 1996

[87] PCT Pub. No.: WO95/13879

PCT Pub. Date: May 26, 1995

[30] Foreign Application Priority Data

Nov. 16, 1993 [GB] United Kingdom ..... 9323647
Dec. 6, 1993 [GB] United Kingdom ..... 932497

[51] Int. Cl.[6] ..... B05B 5/00

[52] U.S. Cl. ..... 239/690.1; 239/290; 239/697; 361/227; 361/228

[58] Field of Search ..... 239/690, 690.1, 239697, 698, 708, 290; 361/227, 228

[56] References Cited

U.S. PATENT DOCUMENTS

| | | | |
|---|---|---|---|
| 4,077,354 | 3/1978 | Walberg . | |
| 4,107,757 | 8/1978 | Masuda et al. . | |
| 4,381,533 | 4/1983 | Coffee | 361/228 |
| 4,401,274 | 8/1983 | Coffee | 239/690 |
| 4,572,438 | 2/1986 | Traylor | 239/708 |
| 4,740,799 | 4/1988 | Mason et al. . | |
| 4,854,506 | 8/1989 | Noakes et al. | 239/708 X |
| 4,993,395 | 2/1991 | Bosch . | |
| 5,184,778 | 2/1993 | Noakes | 239/708 X |
| 5,222,664 | 6/1993 | Noakes et al. | 239/691 X |
| 5,290,600 | 3/1994 | Ord et al. | 427/472 |

FOREIGN PATENT DOCUMENTS

| | | |
|---|---|---|
| 2 024 755 | 9/1990 | Canada . |
| 120633 | 10/1984 | European Pat. Off. . |
| 163390 | 12/1985 | European Pat. Off. . |
| A 0 186 983 | 7/1986 | European Pat. Off. . |
| 0 219 409 | 4/1987 | European Pat. Off. . |
| 441501 | 8/1991 | European Pat. Off. . |
| 468735 | 1/1992 | European Pat. Off. . |
| 468736 | 1/1992 | European Pat. Off. . |
| 482814 | 4/1992 | European Pat. Off. . |
| A 0 487 195 | 5/1992 | European Pat. Off. . |
| 501725 | 9/1992 | European Pat. Off. . |
| A 0 501 725 | 9/1992 | European Pat. Off. . |
| A 0 503 766 | 9/1992 | European Pat. Off. . |
| A 1 137 824 | 6/1957 | France . |
| A 1 265 554 | 5/1961 | France . |
| A 1 562 925 | 4/1969 | France . |
| A 19 37 158 | 2/1971 | Germany . |
| 3731412 A1 | 5/1988 | Germany . |
| A 39 29 808 | 3/1991 | Germany . |
| WO 92/07188 | 4/1992 | WIPO . |
| WO A 94 13063 | 6/1994 | WIPO . |

*Primary Examiner*—Andres Kashnikow
*Assistant Examiner*—Robin O. Evans
*Attorney, Agent, or Firm*—John M. Sheehan; John F. Daniels, III

[57] ABSTRACT

An electrostatic spraying device for use in spraying liquids having resistivities of the order of $5\times10^6$ ohm·cm and viscosities of the order of 1 Poise at a spraying rate up to at least 4 cc/min (especially paint formulations) is provided with an annular shroud (112) of semi-insulating material (e.g. bulk resistivity of the order of $10^{11}$ to $10^{12}$ ohm·cm) which is electrically connected to a high voltage generator (126) for supplying high voltage to liquid emerging at the outlet of the nozzle (114). In this way, a voltage is established on the annular electrode (126) which is of the same polarity, and substantially the same magnitude, as the voltage applied to the liquid thereby modifying the potential gradient in the immediate vicinity of the nozzle outlet so as to allow the use of the high voltage needed to effect efficient spraying of liquids having the specified resistivity and viscosity at flow rates up to at least 4 cc/min.

21 Claims, 3 Drawing Sheets

SPRAYING DEVICE

This invention relates to the electrostatic spraying of liquids by the application of a high voltage to liquid emerging at the outlet of a nozzle whereby an electric field is developed which is effective to draw the liquid into a ligament which is of smaller diameter than the nozzle outlet and breaks up to produce a spray. Devices for effecting electrostatic spraying in this manner are disclosed in our prior EP-A-441501 and 501725.

Although such devices are suitable for spraying liquids of varying resistivities and viscosities, some liquids are less amenable than others to spraying by means of electrostatic devices of this type, especially when there is a requirement for the production of divergent sprays with droplets having a narrow size distribution and with a volume mean diameter (VMD) of 100 microns or less at flow rates up to 4 cc/min or higher. A liquid having a resistivity of the order of $5\times10^6$ ohm·cm and a viscosity of the order of 1 Poise is representative of such liquids which are less amenable to spraying when the spray is to comply with these requirements on droplet size and flow rate. Resistivities and viscosities of this magnitude are typical for paint formulations.

An important parameter governing the VMD of the spray droplets is the potential applied to the liquid emerging at the nozzle outlet. The higher the potential applied, the greater the acceleration of the ligament away from the nozzle and the smaller the diameter of the resulting ligament. However, for liquids having a resistivity of the order of $5\times10^6$ ohm·cm, as the applied potential increases, spurious spraying effects arise which are probably attributable at least in part to corona discharge taking place as the electric field in the vicinity of the nozzle outlet intensifies. The nature of these effects can vary from one nozzle to another but, in general, the spray becomes poorly divergent and polydisperse and is wholly unsatisfactory for many spraying applications, particularly the coating of paints onto substrates.

Flow rates of the order of 4 cc/min or higher can be achieved by providing for forced feed of the liquid to the nozzle outlet (as opposed to a passive feed such as gravity feed or a capillary action as disclosed in for instance EP-A-120633). Forced feed can be achieved in various ways, for instance by means of a propellant gas as disclosed in EP-A-441501 in which a so-called barrier pack is used, or by means of user-applied pressure as disclosed in EP-A-482814.

From EP-A-441501, it is known to provide a focusing shroud of electrically insulating material adjacent the nozzle outlet in order to permit focusing of the spray. From EP-A-501725, it also known to provide a shroud component of electrically insulating material encircling the nozzle with the aim of modifying the potential gradient in the immediate vicinity of the nozzle outlet so as to facilitate the spraying of liquids having resistivities lower than $1\times10^6$ ohm·cm. In both cases, during spraying a voltage is established on the shroud component which is of the same polarity as the voltage produced at the nozzle outlet, that voltage being established as a result of charge collecting on the shroud in the course of the spraying operation.

It is also known from prior U.S. Pat. No. 4,854,506 to provide an electrostatic spraying device in which an electrode is mounted adjacent to the spraying nozzle and in which an electrical potential is applied to that electrode so as to develop an intense electrical field between the liquid emerging at the nozzle and the electrode. The electrode comprises a core of conductive or semiconducting material sheathed in a material of semi-insulating material having a volume resistivity of $5\times10^{11}$ to $5\times10^{13}$ ohm cm and a dielectric strength greater than 15 kV/mm for the purpose of allowing a higher potential to be maintained between the nozzle and the electrode. The potential applied to the electrode may be of the same polarity as the potential applied to the liquid emerging from the nozzle and of a magnitude intermediate the latter potential and the potential of a target to be sprayed. In a specific embodiment, the potential applied to the liquid is 40 kV and to effect field intensification the electrode is maintained at a potential of approximately 25 kV and the liquid to be sprayed has a volume resistivity within the range $10^6$ to $10^{11}$ ohm cm.

According to the present invention there is provided an electrostatic spraying device capable of spraying liquids having resistivities of the order of $5\times10^6$ ohm·cm and viscosities of the order of 1 Poise at a spraying rate up to at least 4 cc/min, said device comprising nozzle means having an outlet, means for positively feeding liquid to be sprayed to said nozzle means, a high voltage generator, means coupled to the high voltage generator for applying a potential to the liquid emerging at the outlet of the nozzle means, an electrode located adjacent the nozzle means to attenuate the field intensity in the vicinity of the outlet of the nozzle means, the electrode comprising a semi-insulating material, and means for electrically connecting the electrode to said high voltage generator to develop on the electrode a potential of the same polarity as the liquid emerging from the nozzle outlet and of a magnitude such that the potential gradient is reduced in the immediate vicinity of the outlet of the nozzle means.

By "semi-insulating material" we mean a material which would be regarded as being insulating rather than conductive, eg with a resistivity of at least $1\times10^7$ ohm·cm, but is sufficiently conductive to allow substantially the full operating potential on the forward extremity of the shroud to build up within a time interval such as to ensure that the full operating potential is established on the forward extremity of the shroud before sufficient liquid has collected at the outlet of the nozzle to support ligamentary spraying thereby avoiding any tendency for the spurious spraying, eg spitting, of the liquid to occur during the initial stages of spraying which is particularly undesirable for paint spraying applications. Also, the fact that the electrode is composed of a semi-insulating material reduces the risk of corona discharges occurring from imperfections or the like on the electrode. Materials having a bulk resistivity of the order of $10^{11}$ to $10^{12}$ ohm·cm are particularly suitable for use as semi-insulating materials in this aspect of the invention.

In contrast with U.S. Pat. No. 4,854,506, the presence of the electrode serves to attenuate the potential gradient near the nozzle whereas U.S. Pat. No. 4,854,506 teaches use of the electrode to intensify the electric field.

The resistivity of the liquid is typically within the range $5\times10^5$ to $5\times10^7$ ohm cm, more usually $2\times10^6$ to $1\times10^7$ ohm cm.

The potential applied to the liquid emerging at the outlet of the nozzle means will normally be in excess of 25 kV, typically up to 40 kV and preferably 28 to 35 kV.

Preferably the potential applied to the electrode is of substantially the same magnitude as that applied to the liquid emerging from the outlet of the nozzle means. In practice, this can be achieved by electrically connecting the electrode and the liquid to a common high voltage output of the voltage generator.

The voltage applied to the liquid may be supplied by means of a connection adjacent the outlet of the nozzle means or it may be supplied via a connection with a cartridge containing the liquid. Where the cartridge comprises a conductive component or components, such as a metal casing or a metal valve, the voltage may be applied to the liquid through the agency of such conductive component.

In one convenient embodiment in which the cartridge comprises a metal casing, the voltage applied to both the liquid and to the electrode is supplied from the generator through the agency of the metal casing.

Particularly where the electrode is fabricated from a semi-insulating material, preferably the nozzle means is fabricated from a material which is more insulating than the material forming the electrode and the nozzle means is typically of tapering configuration converging towards the nozzle outlet.

The outlet may be in the form of a generally circular aperture from which the liquid is projected as a single ligament, in which case the electrode is conveniently of annular configuration such as a shroud or collar of said semi-insulating material.

Preferably the device is suitable for hand-held use and the means for feeding the liquid to the outlet of the nozzle means conveniently comprises a user-operable actuator which may be arranged so that the feed rate is governed by the effort applied to the actuator. Advantageously, the arrangement is such that operation of the actuator of the feed means also effects activation of the voltage generator, preferably in such a way that the voltage is applied to the liquid prior to any liquid being projected away from the outlet means of the nozzle means, thereby avoiding any risk of uncontrolled discharge of liquid from the device and also ensuring that the requisite operating voltage can be established on the electrode prior to commencement of spraying.

For viscous liquids, especially paint formulations suitable for spraying car body panels, the outlet of the nozzle means is desirably at least 500 micron (more preferably at least 600 micron) in diameter in order to achieve the desired spraying/flow rates without requiring undue effort on the part of the user and also to reduce any tendency for blockage by particles suspended in the liquid formulation.

The location of the electrode relative to the outlet means has been found to be particularly critical in terms of securing the production of a divergent spray of droplets having a narrow size distribution. The location will in general depend on the magnitude of the voltage established on the electrode.

In a preferred embodiment of the invention employing a single ligament-producing nozzle means encircled by an annular electrode supplied with a voltage of substantially the same magnitude as the liquid, the electrode is preferably so located that the angle between imaginary lines extending between the forward extremity of the nozzle means and diametrically opposite forward extremities of the annular electrode is in the range 140° to 195°, more preferably between 150° and 180°.

Preferably the device of the invention incorporates circuitry including electronic switching means associated with the high voltage output of the generator for controlling current and/or voltage switching operations of the device.

Such electronic switching means conveniently comprises a series of radiation sensitive semiconductor junctions collectively having a maximum dc reverse voltage of at least 1 kV, terminal means for the application of high voltage to the junctions such that the junctions permit current flow in one direction only when forwardly biased by an applied voltage, and selectively operable, radiation producing means associated with said junctions for selectively irradiating the same so as to produce current flow in the reverse direction when the junctions are reverse biased by an applied voltage, said junctions and the radiation producing means being supported in fixed predetermined relation within a mass of encapsulating material transmissive to the radiation emitted from the radiation producing means.

Preferably said junctions collectively have a maximum dc reverse voltage of at least 5 kV and more preferably at least 10 kV.

It is to be understood that, when said series of junctions are reverse biased and not exposed to radiation from said radiation producing means, there may nevertheless be a small current flow as in the case of a conventional diode (dark current) but the reverse current flow is neglible compared with that produced when the junctions are forwardly biased with a voltage of the same amplitude but opposite polarity. In contrast, when the junctions are reverse biased and subjected to irradiation, the current flow is substantially greater than that occurring in the absence of such irradiation.

The encapsulating mass may be such as to provide reflective surfaces in the vicinity of the junctions so that radiation which is not directly incident on the junctions is reflected thereby increasing the efficiency with which the junctions is irradiated. Such reflective surfaces may be constituted by a specific layer or layers of material reflective to radiation at the wavelength or wavelengths emitted by the radiation producing means; or reflectivity may be obtained as a result of changes in refractive index within the mass of encapsulating material.

It is widely known that silicon diodes having a pn junction are photosensitive and that, when reverse biased and exposed to near infrared radiation, such diodes are rendered conductive and permit current flow substantially in excess of the dark current. This is the principle underlying photodiode operation. In contrast with conventional photodiodes which have an architecture or layout consistent with making effective use of incident light, the switching means according to said one aspect of the invention is designed to operate at voltages substantially in excess of those at which conventional photodiodes are intended to operate. Thus, conventional photodiodes are designed with maximum dc reverse voltages ranging up to 600 volts (see "Optoelectronics", D.A.T.A Digest 1992 (Edition 25) published by D.A.T.A. Business Publishing of Englewood, Colo., USA -"Photodiodes", Page 613) whereas the switching means of this aspect of the invention is intended for use in applications involving high voltages of at least 1 kV, and more usually at least 5 kV ranging up to for example 50 kV.

In a preferred embodiment of the invention, said series of semiconductor junctions constitute a high voltage semiconductor diode, preferably a high voltage silicon diode having a series of stacked pn junctions.

The radiation producing means conveniently comprises a light-emitting diode. As used herein, references to "light" are to be understood to encompass electromagnetic wavelengths lying outside the visible part of the spectrum as well as wavelengths within the visible spectrum. For instance, a suitable form of light-emitting diode produces an output in the near infrared and the high voltage diode forming said series of junctions may be sensitive to such radiation.

Although the components forming the switching means may be fabricated in the form of a large scale integrated circuit, the invention includes within its ambit fabrication of the switching means from discrete components.

The method of fabricating the electronic switching means typically involves assembling a high voltage semiconductor diode and a solid state light-emitting source in predetermined relation such that the series of junctions of the diode are exposed to light emitted by said source, and encapsulating the so related diode and source in an encapsulant material which is transmissive to the light emitted by the source.

The predetermined relation will usually involve positioning of the source in close proixmity with the diode junctions in such a way that a substantial part of the light emitted by the source will be incident on the diode junctions.

This aspect of the invention may be implemented using commercially available discrete components. Commercially available high voltage diodes have an architecture or layout, i.e. a series of stacked pn junctions (typically in excess often such junctions and often twenty or more) appropriate for management of high potential and are fabricated without regard to light-induced effects using encapsulant materials which are not particularly suited to permitting exposure of the junctions to external radiation; indeed, this is generally considered highly undesirable.

Thus, in accordance with this aspect of the invention, the diode may comprise a conventional commercially available high voltage diode encapsulated in an electrically insulating material, in which case the diode selected may be one having an encapsulating material which already has substantial transmissivity with respect to the wavelength of the light emitted by the source or alternatively the source may be selected so as to be compatible with the diode encapsulating material in terms of transmissivity of the latter with respect to the wavelength of light emitted by the source.

Where the commercially available diode is one having an encapsulating material which is opaque or has relatively low transmissivity with respect to the light emitted by the source, the method of the invention comprises modifying the diode encapsulating material to impart, or enhance, effective light coupling between the source and the series of junctions of the diode.

Such modification may involve at least partial removal of the diode encapsulating material or some form of treatment to enhance the light transmissivity of the encapsulating material. For instance, one form of high voltage diode in widespread use is encapsulated in a glass material, the transmissivity of which can be modified by heat treatment.

The electronic switching means referred to above is particularly suitable for electrostatic spraying devices of the type with which the present invention is concerned, especially where current consumption is low (typically no greater than 10 μA, and in some cases no greater than 2 μA) and where factors such as compactness and cheapness are at a premium. Conventional photodiodes are totally unsuitable since they are only capable of use at low voltages and are in any event conventionally only considered in applications involving signal handling as opposed to current handling applications. Most commercially available high voltage switches are geared towards high current applications (e.g. switchgear) and are mechanical in nature, bulky, expensive and totally unsuited for spraying devices of the type just referred to. Reed relays are widely available for low current switching applications but are relatively expensive being electromechanical in nature with high input requirements and short lifetimes and have upper limiting voltages of the order of 12 kV. Any mechanically based switching device is subject to size constraints due to the need for separation of components at elevated voltages.

In one embodiment of the spraying device, the switching means is operable to provide a current discharge path in response to de-energisation of the high voltage generator. In this instance, the switching means may be reverse biased by the high voltage during spraying operation of the device, and the arrangement may be such that, in response to de-energisation of the generator, the radiation producing means is operated to irradiate the switching means and thereby render the latter conducting so as to provide a path for discharge of current from any capacitively stored electrical charge at the high voltage output side of the generator. The capacitive component may be constituted by capacitance associated with the high voltage generator and/or capacitance associated with the load to which the output voltage of the circuitry, eg. a metal can containing liquid, such as paint, to be sprayed.

The switching means, when used in this manner, obviates the need for a resistive element at the output side of the generator for the purpose of discharging any capacitively stored charge which, if not discharged at the time of de-energisation of the high voltage generator, gives rise to a risk of electric shock being experienced by the user. The use of such a resistive element constitutes a current drain during spraying and the high voltage circuitry must therefore be designed to take such current drain into account, with the consequence that the generator necessarily has to produce a current output in excess of that strictly required for spraying purposes.

In the interests of compactness and cheapness, it is desirable to avoid current drain of this nature. This is particularly the case for hand held or readily portable self-contained spraying devices of the type intended to be powered by a low voltage battery supply, for example hand held devices for spraying of paint compositions. Where a low voltage battery supply is employed, unnecessary power consumption should obviously be eliminated as far as possible in order to prolong battery life. Also, for reasons of economy, the output requirements of the high voltage circuitry design will desirably be minimised to permit the use of inexpensive circuit designs. The switching means when incorporated in a device in accordance with the invention is particularly suitable where the above constraints apply because the current drain is limited to the dark current component (which is negligible in practice) and, when the high voltage generator is disabled, the switching means may be rendered conductive in the reverse bias direction to effect discharge of stored charge.

In this embodiment of the invention, the switching means may be rendered conductive automatically in response to operation of a user-actuable switch for de-energising the high voltage generator and discontinuing spraying. Thus, the device conveniently includes user-actuable means for selectively energising and de-energising the high voltage generator and control means for triggering emission of radiation by the radiation producing means to render the switching means conductive in response to operation of the user-actuable means to effect de-energisation of the high voltage generator.

Conveniently the switching means may, when arranged to afford a path for discharge of capacitively stored charge, be coupled to or within the high voltage generator in such a way as to provide rectification. For instance, in this event, the high voltage generator may include a step-up transformer with one side of the secondary thereof tapped to provide an alternating high voltage output and the other side of the secondary connected to a low potential such as earth, and the switching means may be connected in series with the secondary to rectify the alternating voltage and thereby produce a unipolar high voltage output which may be subjected to capacitive smoothing to remove or at least substantially attenuate high voltage peaks. In such an arrangement, when the circuitry is de-energised, charge stored by the capacitive smoothing component is discharged to said low potential (e.g. earth) by rendering the switching means conductive in the reverse bias direction and the switching means may be placed in this condition automatically in response to de-energisation of the high voltage generator.

According to another aspect of the present invention there is provided an electrostatic spraying device comprising a housing, nozzle means, means for supplying to the nozzle means material to be sprayed, high voltage generating circuitry having an output terminal via which high voltage is applied to said material to effect electrostatic spraying thereof, an annular element of semi-insulating material encircling the nozzle means and connectible to said circuitry whereby a high voltage of the same polarity as that applied to said material is established during spraying to modify the field intensity in the immediate vicinity of the nozzle outlet, and means operable upon cessation of spraying to discharge electrical charge stored by capacitive elements of the device during spraying.

Said discharge means preferably comprises a switching means as referred to hereinbefore and the voltage generating circuitry is preferably operable to produce an output voltage of at least 25 kV. Voltages of this magnitude are necessary when the liquid to be sprayed is relatively viscous and/or where there is a requirement for a wide range of flow rates; such voltages are normally considered to be in excess of those that can be employed without giving rise to spurious spraying effects believed to be attributable at least in part to corona discharge effects. Also, operation with voltages of this magnitude lead to capacitive storage of large amounts of electrical charge giving rise to the possibility of the user receiving an unpleasant shock in certain circumstances. The combination of features forming this last mentioned aspect of the invention allows large voltages to be used whilst securing satisfactory spraying of relatively viscous, low resistivity liquids such as paint formulations and affording the user protection against discharge of capacitively stored charge.

The invention will now be described by way of example only with reference to the accompanying drawings, in which.

Figure 3:
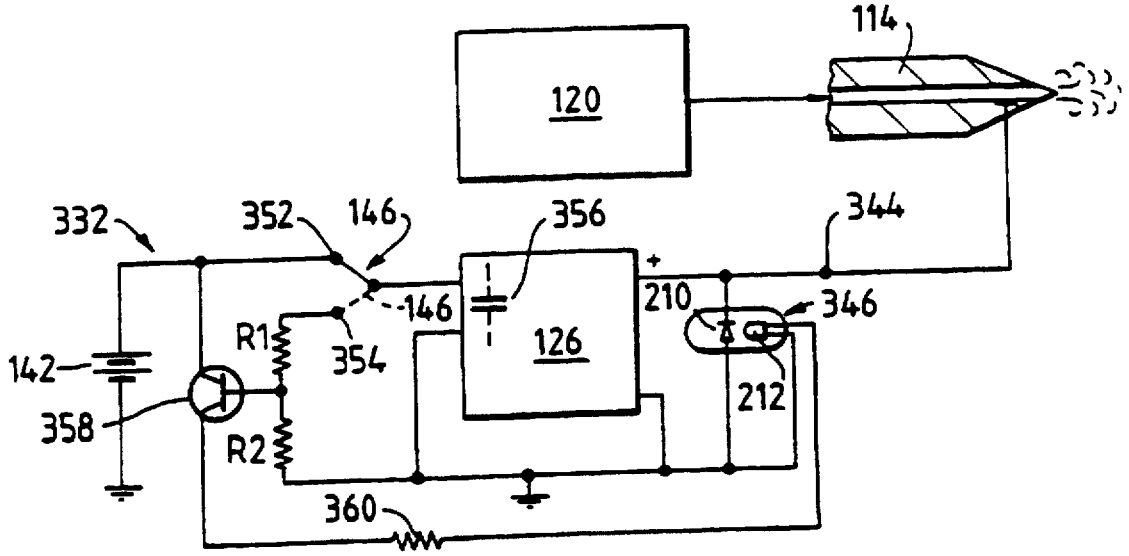
FIG. 3 is a diagrammatic view of an electrostatic spraying device incorporating high voltage generating circuitry embodying an electronic switching means of the form shown in FIG. 1.
Figure 4:
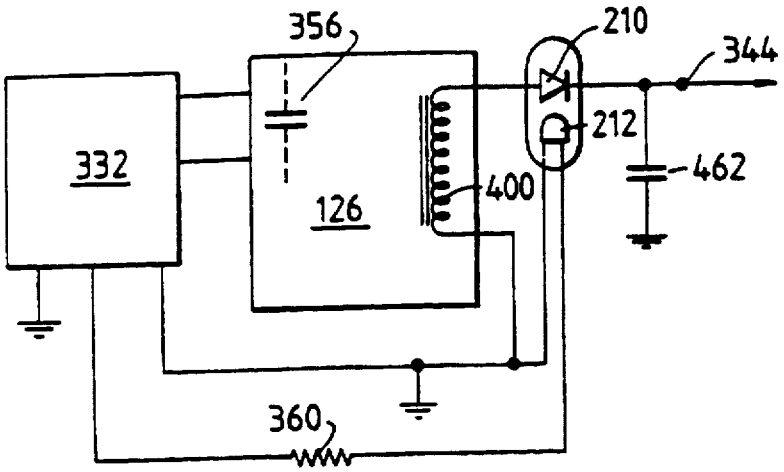
Figure 5:
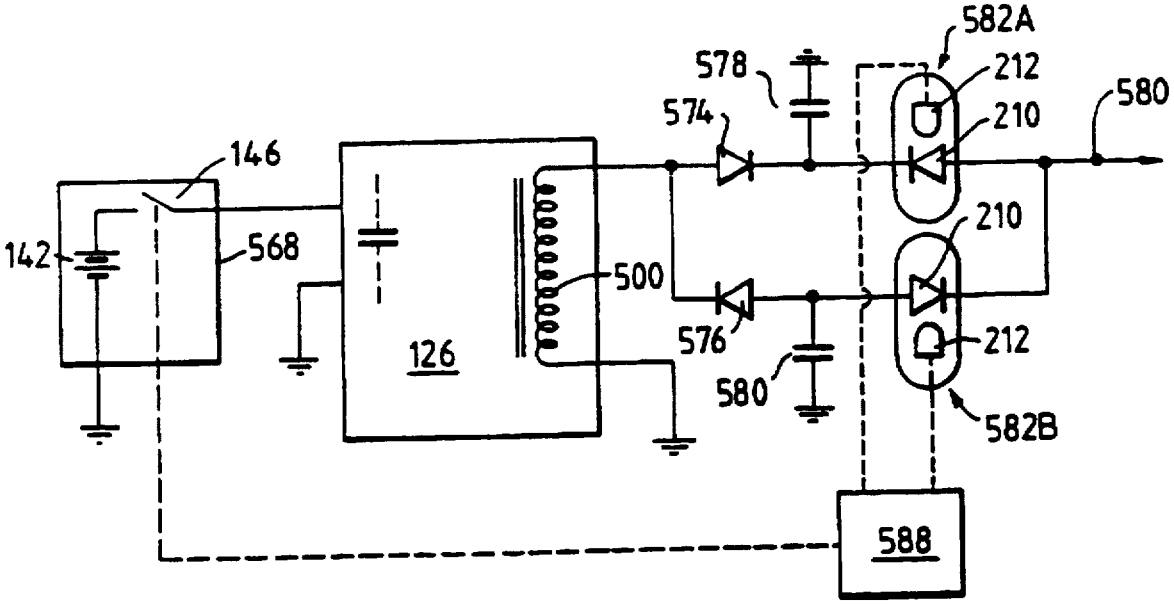

FIG. 4 is a diagrammatic view of a modified form of the embodiment shown in FIG. 3; and FIG. 5 is a diagrammatic view of circuitry for generating a bipolar high voltage output for use in for example an electrostatic spraying device requiring a bipolar output for shock suppression and/or permitting the spraying of targets which ordinarily are difficult to spray, eg. targets of electrically insulating material.

Referring to the spray gun illustrated is intended for hand-held use and is suitable for use in spraying relatively viscous, low resistivity liquid formulations such as paints, at flow rates of up to at least 4 cc/min. A typical formulation to be sprayed has a viscosity of the order of 1 Poise and a resistivity of the order of $5\times10^6$ ohm-cm. The spray gun comprises a body member 102 and a hand grip 104. The body member 102 is in the form of a tube of insulating plastics material, eg a highly insulating material such as polypropylene. At the end remote from the hand grip 104, the body member is provided with a collar 106 which is also composed of a highly insulating material such as polypropylene and which is screwthreadedly or otherwise releasably engaged with the body member 102 for quick release and access to the liquid container. The collar 106 secures a component 108 in position at the end of the body member 102, the component 108 comprising a base 110 and an integral annular shroud 112 which projects forwardly of the gun.

The base 110 has a central aperture through which a nozzle 114 projects, the rear end of the nozzle 114 being formed with flange 115 which seats against the rear face of the base 110. The nozzle 114 is composed of a highly insulating material such as a polyacetal (e.g. "Delrin"), typically with a bulk resistivity of the order of $10^{15}$ ohm·cm The body member 102 receives a replaceable cartridge 116 for delivering liquid to be sprayed to the nozzle 114. As the gun is required to deliver liquid at a flow rate of up to at least 4 cc/min, a positive feed of liquid to the nozzle 114 is needed and in this embodiment of the invention is effected by the use a cartridge in the form of a so-called barrier pack comprising a metal container 118 pressurised by a liquefied propellant, e.g. fluorocarbon 134A, the liquid to be sprayed being enclosed within a flexible metal foil sack 120 which separates the liquid from the propellant. The interior of the sack 120 communicates with an axial passage 122 within the nozzle via a valve 124 which operates in a similar manner to the valve of a conventional aerosol-type can in that displacement of the valve in the rearward direction relative to the container 118 opens the valve 124 to permit positive liquid flow into the passage 122 (by virtue of the pressurisation produced by the propellant). The passage 122 terminates at its forward end in a reduced diameter bore forming the outlet of the nozzle. The forward extremity of the nozzle 114 terminates close to or at a plane containing the forward extremity of the shroud 112.

Rearwardly of the cartridge 116, the body member 102 accommodates a high voltage generator 126 which is mounted in a tubular carrier 128. The carrier 128 is mounted for limited sliding movement axially of the body member 102. A tension spring 130 biases the carrier 128 rearwardly. The high voltage generator 126 is of the type which produces a pulsed output and then rectifies and smooths it to provide a high voltage DC output. A suitable form of generator 126 of this type is described in EP-A-163390. The generator has a high voltage output pole 132 connected by lead 133 to a contact 134 secured to the carrier and arranged for engagement with the rear end of the metal container 118. A second output pole 135 of the generator is arranged to be connected to earth via lead 136, resistor 138 and a conductive contact strip 140 secured to the exterior surface of the hand grip 104 so that, when the gun is held by the user, a path to earth is provided through the user. The generator is powered by a low voltage DC supply comprising battery pack 142 accommodated within the handgrip 104 and forming part of a low voltage circuit including lead 136 coupled to earth (via the resistor 138 and the user) and a lead 144 connecting the battery pack 142 to the input side of the generator 126 via a microswitch 146.

The valve 124 is opened, in use, by relative movement between the cartridge 116 and the body member 102, the nozzle 114 remaining fixed relative to the body member. Movement to operate the valve 124 is applied to the cartridge 116 by movement of the generator/carrier assembly, the latter being moved by operation of a trigger 148 associated with the handgrip 104 and which, when squeezed, pivots lever 150 about its pivotal connection 152 thereby pivoting a further lever 154 which is pivoted at 156 and is coupled to lever 150 by link 158. The lever 154 bears against the rear end of the carrier 128 so that pivoting of the lever 154 is effective to displace the carrier and hence the cartridge 116 forwardly thereby opening the valve 124. Upon release of the trigger 148, the various components are restored to their starting positions as shown by suitable biassing means including spring 130. Squeezing of the trigger 148 is also accompanied by movement of a linkage 160 which is coupled to the microswitch 146 so that trigger operation is accompanied by microswitch operation to supply low voltage power to the generator 126.

The high voltage produced by the generator, typically in excess of 25 kV for a device designed to spray relatively viscous, low resistivity liquids at flow rates of up to at least 4 cc/min (eg up to 6 cc/min or even more), is coupled to the outlet of the nozzle 114 via contact 134, the metal container 118 and the liquid within the passage 122 to provide an electric field between the nozzle tip and the surroundings at earth potential. This electric field is established with the aim of drawing the liquid emerging at the nozzle outlet into a ligament which will break up into a divergent spray of relatively uniformly-sized, electrically charged droplets suitable for deposition as a uniform film. Because of the relatively viscous nature of the formulation to be sprayed (eg of the order of 1 Poise), the diameter of the outlet has to be made relatively large (typically at least 600 microns) in order to achieve flow rates up to at least 4 cc/min. Also, with relatively viscous materials, to achieve satisfactory ligament formation (especially single, axially directed ligament formation) at flow rates of this order, it is necessary to operate at higher voltages than are necessary for lower viscosity liquids since ligament formation from viscous materials requires increased electric field intensity.

For this reason, the generator 126 employed has an output voltage of 25 kV or greater as measured by connecting the high voltage output of the generator to a Brandenburg 139D high voltage meter having an internal resistance of 30 Gigohm. However, the use of voltages of this order would normally lead to spurious spraying probably as a result of corona discharge effects since the field intensity in the immediate vicinity of the nozzle outlet may exceed the breakdown potential of air. Such spurious spraying may for instance result in highly polydisperse droplets in the form of a mist of very fine droplets splitting off from the ligament and poorly divergent, paraxial streams of coarse droplets.

Satisfactory ligament formation and break up in the presence of voltages of 25 kV or greater is achieved by provision of the component 108 and in particular the annular shroud portion 112. The component 108 is composed of a semi-insulating material (typically with a bulk resistivity up to $10^{11}$–$10^{12}$ ohm·cm), e.g. "Hytrel" grade 4778 available from DuPont Corporation, and is arranged with a rearwardly projecting annular portion 162 thereof in contact with the metal container 118 so that the voltage applied via the contact 134 is established at the forward extremity of the shroud 112 and is of the same polarity as, and of substantially the same magnitude as, the voltage produced at the outlet of the nozzle 114. The annular portion 162 is trapped between the forward end of the body member 102 and a flange 164 on collar 106 so that component 108 is fixed relative to the body member 102. Operation of the trigger 148 leads to displacement of the container 118 relative to the component 108 but electrical continuity is maintained by sliding contact between the leading end of the container 118 and the inner periphery of the annular portion 162.

It will be understood that contact between the high voltage generator and the shroud may be effected in ways other than the sliding contact arrangement shown; for instance the contact may be made through a spring contact. Usually the contact arrangement will be such as to ensure that a voltage substantially corresponding to that established at the nozzle tip is developed on the shroud in advance of, or substantially simultaneously, with the commencement of spraying so that the shroud is immediately effective on commencement of spraying.

By appropriate location of the forward extremity of the shroud relative to the tip of the nozzle, the field intensity in the immediate vicinity of the nozzle tip can be attenuated sufficiently to produce formation of a single ligament which breaks up into relatively uniform-sized droplets. The optimum position of the shroud extremity can be readily established by trial and error, ie by means of a prototype version of the gun having an axially adjustable shroud. In this way, the shroud can be adjusted forwardly from a retracted position while observing the nature of the spray. Initially, with the shroud retracted, the spurious spraying effects referred to above are observed and as the shroud is moved forwardly a position is reached where the spray quality improves markedly and relatively uniform-sized droplets are obtained. Adjustment beyond this point does not affect the quality of spraying initially but tends to have a focusing effect. In practice, where the voltage established on the shroud extremity is of substantially the same magnitude as that on the nozzle tip, we have found that the optimum position tends be one in which the tip of the nozzle more or less coincides with a plane containing the forward extremity of the shroud; in a typical arrangement, using a shroud having an internal diameter of 16 mm and an external diameter of 20 mm, the nozzle tip projects about 1 mm beyond this plane. Usually the arrangement will be such that the angle between imaginary lines extending between the forward extremity of the nozzle and diametrically opposite forward extremities of the shroud is in the range 140° to 195°, more preferably 150° to 180° (angles less than 180° corresponding to the nozzle forward extremity being forward of the shroud and angles greater than 180° corresponding to the shroud being forward of the nozzle forward extremity).

The marked difference in the nature of ligament break up can be demonstrated by operating two nozzles under identical conditions with the same liquid, one nozzle being operated without a shroud and the other with a shroud located at an optimum position. A typical break up regime in the case where no shroud is present involves the production of a mist of very fine droplets a short distance from the nozzle outlet followed by break up of the central core of the ligament into streams of poorly divergent coarse droplets. The spray produced in this instance is wholly unsuitable for the production of a uniform film of the liquid (e.g. paint) on a surface to be sprayed. In contrast, with a shroud located in an optimum position and operating at substantially the same voltage as that prevailing at the nozzle tip, the ligament was observed to travel a substantial distance from the outlet of the nozzle before breaking up into divergent streams of droplets having a narrow size distribution. The production of a spray with droplets having a volume median diameter of less than 100 microns was readily achievable when the nozzle was operated with the shroud in an optimum position The presence of the metal container 118, coupled with the relatively high voltage applied at the tip of the nozzle (i.e. usually greater than 25 kV), can lead to a large build up of capacitively stored charge during spraying with the possibility of the user experiencing an unpleasant electric shock if the user attempts to access the interior of the device on cessation of spraying, eg for the purpose of replacing the cartridge. This possibility may be obviated by the incorporation of means for discharging the capacitively stored charge in response to cessation of spraying. One such means may be implemented by means of a high voltage switch such as that described with reference to FIG. 2.

Figure 1:
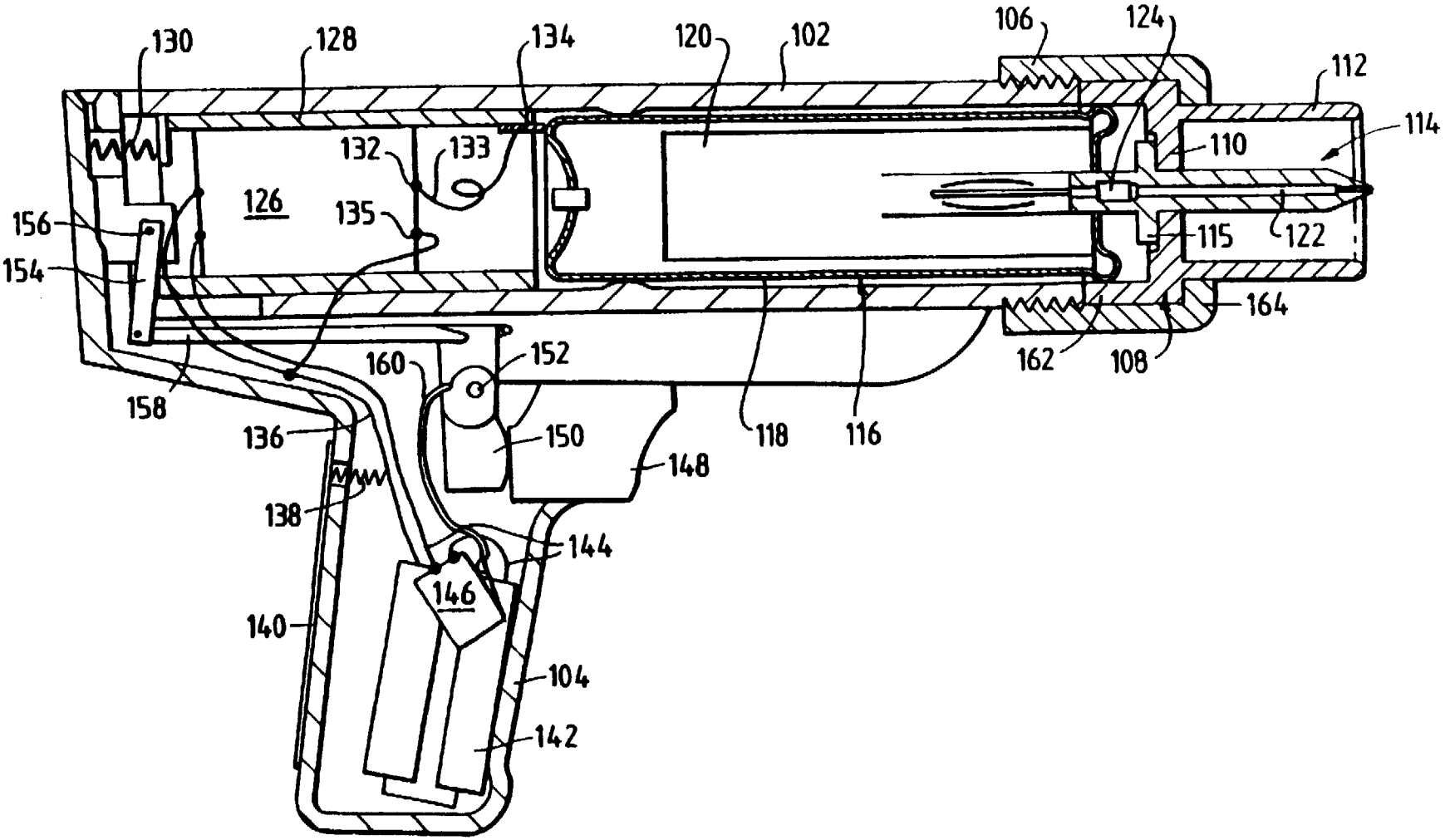
FIG. 1 is a schematic view of one form of spray gun embodying features of the present invention.
Figure 2:
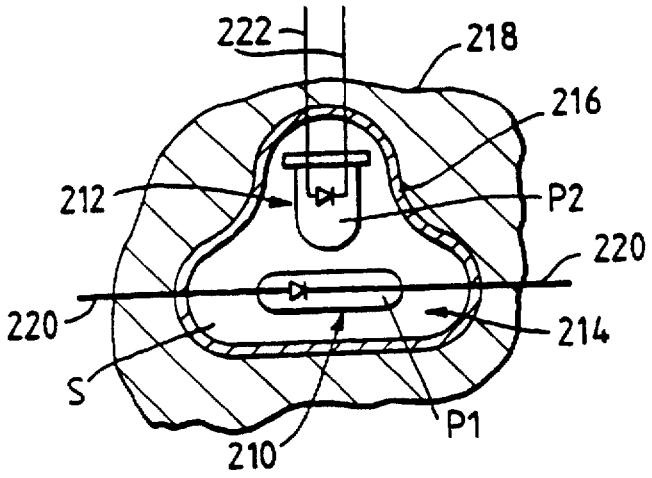
FIG. 2 is a schematic view showing one embodiment of a light sensitive high voltage electronic switching means for use in a spray gun such as that illustrated in FIG. 1.

Referring to FIG. 2, the high voltage switch comprises an extra high tension diode 210 which may typically be constituted by a Philips EHT diode, Part No. BY713 (available from RS Components Limited, Part No. RS 262-781). This diode is a silicon diode comprising a series of stacked pn junctions encapsulated in a mass of encapsulating material P1 (herein called the primary encapsulant) and designed for use in high voltage applications, the maximum dc reverse voltage of the diode being 24 kV. A light source in the form of a light-emitting diode (LED) 212 also encapsulated in a mass of encapsulating material P2 (primary encapsulant, but not necessarily the same material as the material P1) is mounted in close proximity with the EHT diode 210 so that the light emitted by the LED 212 when energised is incident on the EHT diode 210. Typically the LED 212 is constituted by a high powered infrared emitting LED such as that available from RS Components Limited, Part No. RS635-296. Both the EHT diode 210 and the LED 212 are encapsulated as supplied. Where the switch is fabricated from discrete components as in the case of FIG. 1, selection of an EHT diode with an encapsulant having at least some degree of transmissivity with respect to the wavelength of light produced by the LED is advantageous. Thus, we have found the above combination of components advantageous since the Philips BY713 EHT diode as supplied has a glass encapsulant which is transmissive with respect to the wavelength of IR produced by a RS635-296 LED.

During fabrication, the EHT diode 210 and LED 212 are assembled in optically aligned relationship to ensure that the IR emitted by the LED 212 is fully effective in irradiating the pn junctions of the diode 210, taking into account the fact that the architecture of the diode 210 is aimed at high voltage management rather than light collection (as in the case of a photodiode). The EHT diode 210 and LED 212, once suitably aligned, are then encapsulated in a mass 214 of material (secondary encapsulant S) having appropriate transmissivity with respect to the wavelength of emission of the LED. The encapsulating mass 214 is moulded around the diode 210 and LED 212 in such a way as to avoid the development of air gaps at the respective interfaces and which would tend to act as reflective boundaries. This can be readily achieved by adopting a moulding technique which ensures that any shrinkage that occurs during curing of the encapsulating material takes place at the outer peripheral surface of the mass 214 rather than at the interfaces with the diode 210 and LED 212. To avoid deleterious boundary effects, the encapsulating material forming the mass 214 is selected so as to provide at least reasonable refractive index matching with the encapsulating materials of the diode 210 and LED 212. In the case of the specified components (the BY713 diode and RS635-296 LED), suitable encapsulating materials are the light curing resin LUXTRAK LCR 000 (LUXTRAK is a RTM of Imperial Chemical Industries Group of companies) and the UV curing resin RS505-202 available from RS Components. The secondary encapsulant S additionally serves to provide a high degree of electrical insulation between the diode 212 at low voltage and the HT diode 210 at high voltage.

As indicated above, it is important that the moulding procedure for encapsulating the diodes 210 and 212 in the secondary encapsulant S is conducted in such a way as to ensure that the radiation emitted by diode 212 is used efficiently. In particular, care must be taken to prevent the formation of interlayer voidages between the primary and secondary encapsulants. Such voidages tend to arise as a result of internal stresses set up as the secondary encapsulant shrinks on curing. This can be achieved by applying a release agent to the mould to prevent the secondary encapsulant adhering to the sides of the mould so that the curing secondary encapsulant preferentially adheres to the primary encapsulant during shrinking rather than to the mould surfaces. Alternatively, instead of using a release agent, the mould may be lined with a flexible film liner to prevent the secondary encapsulant adhering to the mould surfaces.

As mentioned previously, the architecture of conventional high voltage diodes is not geared to making effective use of incident light; indeed many high voltage diodes are encapsulated in material which is effective to shield the pn junctions from light exposure. In contrast, advantage is taken of the known affect that light has on pn junctions and, where the switch is fabricated using a commercially available discrete high voltage diode, rather than shielding the diode from light exposure, it is desirable to maximise light exposure given that the architecture is not optimised for light collection. Thus, where enhancement of the light exposure is needed, in addition to locating the LED 212 in close proximity with, and in an optimal orientation relative to, the EHT diode 210, provision is made of a reflecting surface or surfaces to re-direct light which is not directly incident on the EHT diode.

In the illustrated embodiment, this is implemented by means of a layer or coating of material 216 which encompasses the EHT diode 210 and LED 212 and serves to reflect light towards the sites on the EHT diode at which light exposure is required. At least part of the layer/coating 216 is conveniently of approximately spherical contour. The layer/coating 216 may for instance be composed of MgO.

The assembly of EHT diode 210, LED 212 and encapsulating mass 214 is enclosed in a mass of potting compound 218 (tertiary encapsulant) which has good electrical insulating properties and encloses the assembly in such a way as to leave the leads 220 of EHT diode 210 and electrodes 222 of LED 212 exposed for connection to external circuitry while shielding the diode 210 from ambient light. If the tertiary encapsulant is appropriately selected, it is possible to dispense with the separate reflecting layer 216; for example, the tertiary encapsulant 218 may be a white reflective material, such as that available from RS components, Part No. RS552-668.

The shape and dimensions of the assembly are selected in such a way that suitable electrical insulation is provided between the low voltage at which the diode 212 operates and the much higher voltage at which the HT diode 210 operates. Where for instance only a secondary encapsulant is used (with or without the reflecting layer 216), the shape and dimensioning of the secondary encapsulant is selected so that the distances between the high and low voltage leads 220, 222 as measured across the exposed surface of the secondary encapsulant is at least 3 mm for each kV applied to the HT diode 210. If however the assembly is encapsulated within a potting compound (for instance along with other components collectively forming an electrical circuit with the assembly comprising diodes 210 and 212), the external surface of the secondary encapsulant is not exposed to air and the shaping and dimensioning in this case is such as to allow a distance between leads 220, 222, measured across the external surface of the secondary encapsulant, of at least 1 mm for each kV to be applied to the diode 210.

In the case of a RS635-296 LED, the threshold voltage of about 1.3 V has to be exceeded to produce the light necessary to render the high voltage diode conducting in the reverse direction. The LED typically only requires 1 mA to open the switch but it is preferred, especially when used for the production of a bipolar output as described hereinafter with reference to FIG. 4, that the initial peak current to the LED should be up to about 300 mA to afford maximum current carrying capability, followed by a current supply of 5–30 mA (preferably 5–10 mA) to maintain sufficient HT output current flow for a typical application such as electrostatic spraying as described hereinafter.

One application of a high voltage, low current switch, such as that described above with reference to FIG. 2 to the device of FIG. 1, is illustrated in FIG. 3 which shows schematically the layout of the voltage producing circuitry of the device of FIG. 1. As shown in FIG. 3, the high voltage generator 126 powered by a low voltage circuit 332 comprising battery pack 142 and user-actuable switch 146 with a connection to earth.

Operation of the trigger 148 in the device of FIG. 1 serves to operate the switch 36 and apply pressure to a reservoir 120 containing liquid for supply to the nozzle 114 from which the liquid is electrostatically sprayed in use.

The high output voltage (shown as positive in the illustrated embodiment) of the generator 120 is applied to an output terminal 344 which is connected, in use, in some suitable fashion so that the liquid emerging at the outlet of the nozzle 114 is charged. In FIG. 3, the terminal 344 is shown connected to an electrode disposed in the liquid feed path through the nozzle 114; in an alternative arrangement, the terminal 334 may for instance be electrically connected to the liquid at a location upstream of the nozzle outlet, e.g. the electrical connection may be made via a contact penetrating the wall of the reservoir 120 if made of insulating material or via the reservoir wall if made of conductive material. The terminal 344 is also connected to the shroud (not shown) of the device.

The high voltage generator 126 may be of the type employing an oscillator connected to the dc low voltage circuit 332 and serving to produce an alternating substantially square wave output which is fed to a step-up transformer from the secondary winding of which the high output voltage (in the form of a pulse train typically having a frequency of the order of 20 Hz) is tapped and fed to the output terminal 344 via a rectifier and capacitance circuit so as to provide a unipolar high voltage typically of the order of 10 to 30 kV as measured by connecting the high voltage output of the generator to a Brandenburg 139D high voltage meter having an internal resistance of 30 Gigohm. The capacitance provides smoothing of the pulse train and serves to eliminate very high voltage peaks in the secondary output which may approach up to about 100 kV.

The electrostatic field developed between the emerging liquid and a low potential (e.g. presented by a specific target, by the surroundings or by a low potential electrode mounted on the device in the vicinity of the nozzle) is effective to draw the liquid into one or more ligaments which then break up to produce a spray of electrically charged droplets. The liquid is typically fed under sufficient pressure to effect discharge thereof as a weak jet and the electrostatic field may be effective to cause the jet to neck to a diameter substantially smaller than the orifice from which the jet issues, thereby forming a ligament which breaks to produce a spray of charged droplets.

Upon cessation of spraying, eg as a result of releasing the trigger and opening switch 46, even though the generator 126 is de-energised, there may be residual charge stored in the system, for example charge stored by capacitance associated with the load (e.g. any metal components such as a metal container forming the reservoir for the liquid or any metal components on the high voltage side of the generator 126). Unless appropriate expedients are employed, this stored charge poses a potential risk of electric shock for the operator, for instance if the operator, immediately on cessation of spraying, attempts to gain access to the container for the purposes of replacing the same.

In heavy duty spraying devices of the type used for industrial purposes and powered by an ac power source separate from the spraying device, a commonly used solution is to couple the high voltage output of the generator to earth through a bleed resistor so that when spraying is discontinued, the residual charge is rapidly discharged to earth via the bleed resistor. To secure rapid discharge, the value of the bleed resistor is relatively low. Thus, the power supply to the device is arranged to supply sufficient power to compensate for the continual current drain imposed by the low value bleed resistor. For industrial equipment powered by a separate ac source, this does not pose a particular problem. However, in the case of a compact and inexpensive spraying device intended for spraying consumer products (eg paints and such like) where the power source is in the form of a dc battery supply housed within the device, it is not commercially viable to use a bleed resistor which will would otherwise bleed a significant amount of current during spraying.

As shown in FIG. 3, to provide a discharge path for residual capacitively stored charge at the time of de-energisation of the generator 126, a switch 146 as described with reference to FIG. 2 is coupled between the positive high voltage output terminal 344 and earth with the EHT diode 210 reverse biased. During normal spraying operation, the LED 212 is inactive and the diode 210 is effectively non-conducting except for a neglible flow of dark current. When generator 126 is de-energised, the LED 212 is activated temporarily thereby rendering the EHT diode conducting in the reverse direction to provide a path to earth for the residual stored charge.

Activation of the LED 212 is effected automatically in response to release of the trigger by the user. Trigger release is accompanied by movement of the switch 146 from pole 352 to pole 354 thereby coupling resistive divider R1, R2 to the input of the input side of the generator 126. As a result, internal capacitance depicted by reference numeral 356 at the input side of the generator 126 is discharged to earth via the divider R1, R2. This current flow develops a control voltage at the base of transistor switch 358 which is switched to an "on" state to couple the LED 212 to the battery power supply 142 via current limiting resistor 360. In this way, the LED is activated to render the EHT diode 210 conductive to dissipate the residual charge.

The control current derived from the internal capacitance 356 is effective for only a limited time interval governed by the time constant of the resistive/capacitive network formed by the components 356, R1, R2. Once the control current decays, the transistor switch 358 reverts to an "off" condition and LED 212 is de-activated. In practice, the circuit will be designed to ensure sufficient (usually complete) and rapid discharge of the residual charge at the output side of the generator 126 to obviate any risk of electric shock to the operator.

In FIG. 3, only one switch is shown; however in some cases, especially when the high voltage output of the generator is particularly large, e.g. 30 kV or more, there may be two switches (or even more, although two will suffice for most purposes) arranged with the EHT diodes 210 thereof in series between the output terminal 344 and earth in this event, the circuit will be modified appropriately to energise both LED's 212.

In FIG. 3, the EHT diode 210 is arranged in reverse-biased relation to the high voltage output applied to the terminal 210. In an alternative arrangement, it can be arranged to provide a dual function, namely discharge of the residual charge when spraying is discontinued and rectification of the output produced at the secondary of the step-up transformer of the generator 126. Referring to FIG. 4, as this embodiment is generally similar to that of FIG. 3 the low voltage circuit 332 is shown in the form of a block but it will be understood that it is in the same form as in FIG. 3; also in FIG. 4 like components are depicted by the same reference numerals as in FIG. 3. The manner of operation of the embodiment of FIG. 4 is generally the same as that of FIG. 3 except in the respects described below. The EHT diode 210 in this case is coupled in forward-biased condition between the secondary winding 400 of the step-up transformer and the output terminal 344. Capacitor 462 (which may be a discrete circuit component or may be a capacitance presented by the load) serves to eliminate high voltage peaks and provide smoothing as described in relation to FIG. 3.. In operation of the generator 126, the secondary output is rectified by the EHT diode 210 to provide a unipolar output to the terminal 344. When spraying is discontinued and the generator 126 de-energised, the LED 212 is temporarily activated in the manner described in relation to FIG. 3 to render the EHT diode 210 conductive in the reverse bias direction thereby providing, via the secondary 400, a discharge path to earth for residual charge stored by capacitor 362 and capacitance associated with the load.

FIG. 5 illustrates an embodiment employing the switches as described with reference to FIG. 2 for the purpose of producing a bipolar output at the output terminal of a device of the form shown in FIG. 1. A device producing a bipolar output may be used for shock suppression as disclosed in EP-A-468736 or for effecting spraying of targets which are normally difficult to spray electrostatically (e.g. targets composed of electrically insulating material), as disclosed in EP-A-468735. The disclosures of EP-A-468735 and 468736 are incorporated herein by reference.

In FIG. 5, the high voltage generator 126 is connected at its low voltage input to a dc battery supply 142 and a user-actuated switch 146 forming part of a low voltage circuit 568. The high voltage side of the secondary winding 500 of the step-up transformer incorporated in the high voltage generator 126 produces a high voltage in the form of an alternating pulse train (typically having a frequency of the order of 20 Hz) which is coupled to a pair of conventional high voltage diodes 574, 576 arranged in parallel but biased oppositely. The alternating EMF induced in the secondary winding 500 is therefore rectified, diode 574 passing the positive going cycles of the voltage and diode 576 passing the negative going cycles. Capacitors 578, 580 are associated one with each diode 574, 576 to eliminate voltage peaks and provide smoothing of the pulses. Switching elements 582A, B control coupling of the generator voltage to the output terminal 580 which in turn is coupled to the nozzle in any suitable fashion to apply high voltage to the liquid emerging at the nozzle outlet. Each switch 582A, B comprises a high voltage diode 210 and associated LED 212 and is arranged to function in the manner previously described.

Each diode 210 is connected in series and in back-to-back relation with a respective one of the conventional diodes 574, 576. Activation of the LED's 210 is controlled by control circuit 588 in such a way that the diodes 210 are alternately and cyclically rendered conductive in the reverse bias direction, control circuit 588 being activated in response to closure of user-actuated switch 146 (eg actuated in response to squeezing of a trigger associated with a hand grip portion of the device). Control circuit 588 is designed so that diodes 210 are rendered conductive alternately with a frequency appropriate to the effect to be achieved by means of the bipolar output, eg shock suppression or spraying of insulating targets as disclosed in EP-A-468736 and 468735. Thus, for example, the control circuit 588 may be operable to control conduction of the diodes 210 in such a way as to produce a bipolar output at terminal 580 of generally square wave form with a frequency of the order of up to 10 Hz, typically 1 to 2 Hz.

The spray gun illustrated in FIG. 1 (including modifications thereof as described in relation to FIGS. 2 to 5) is particularly suitable for spraying liquids having viscosities between 0.5 and 10 Poise (especially 1 to 8 Poise) and resistivities between $5\times10^5$ and $5\times10^7$ ohm·cm (especially between $2\times10^6$ and $1\times10^7$ ohm·cm) at spraying/flow rates of up to at least 4 cc/min and more preferably up to 6 cc/min. The diameter of the nozzle outlet and the voltage output of the voltage generator 126 are selected according to the viscosity and resistivity of the liquid to be sprayed. Typically the nozzle outlet will have a diameter of at least 500 microns, more usually at least 600 microns, in order to avoid blockage by any particles suspended in the relatively viscous liquid (e.g. as in the case of a paint formulation) and to achieve the desired spraying/flow rates with the pressure available from the propellant used in the container 118. The DC output voltage of the generator 126 will typically be between 25 and 40 kV, more usually between 28 and 35 kV, as measured by a Brandenburg 139D high voltage meter having an internal resistance of 30 Gigohm. Although it is simpler to connect the shroud 112 to the output of the generator 126 so that the voltage established on the shroud is of substantially the same magnitude as that prevailing at the tip of the nozzle, we do not exclude the possibility of the shroud voltage being significantly different from that of the nozzle tip; in this event, the difference in voltages can be compensated for by appropriate positioning of the shroud relative to the nozzle tip so as to secure the desired divergent spray of droplets having a narrow size distribution.

We claim:

1. An electrostatic spraying device capable of spraying liquids having resistivities of the order of $5\times10^6$ ohm·cm and viscosities of the order of 1 Poise at a spraying rate up to at least 4 cc/min, said device comprising nozzle means having an outlet, means for positively feeding liquid to be sprayed to said nozzle means, a high voltage generator, means coupled to the high voltage generator for applying a potential to the liquid emerging at the outlet of the nozzle means, an electrode located adjacent the nozzle means to modify the field intensity in the vicinity of the outlet of the nozzle means, the electrode comprising a semi-insulating material, and means for electrically connecting the electrode to said high voltage generator to develop on the electrode a potential of the same polarity as the liquid emerging from the nozzle outlet and of a magnitude which is substantially the same magnitude as that applied to the liquid such that the potential gradient is reduced in the immediate vicinity of the outlet of the nozzle means.

2. A device as claimed in claim 1 in which said semi-insulating material has a resistivity of at least $1\times10^7$ ohm·cm.

3. A device as claimed in claim 1 in which said semi-insulating material has a resistivity of the order of $10^{11}$ to $10^{12}$ ohm·cm.

4. A device as claimed in claim 1 in which the potential applied to the liquid emerging at the outlet of the nozzle means is in excess of 25 kV.

5. A device as claimed in claim 1 in which the high voltage is applied to the liquid emerging at the nozzle through the bulk of the liquid.

6. A device as claimed claim 1 in which said means for feeding liquid to the outlet of the nozzle means comprises a user-operable actuator arranged so that the feed rate is governed by the effort applied to the actuator.

7. A device as claimed in claim 6 in which the arrangement is such that operation of the actuator of the feed means also effects activation of the voltage generator in such a way that the voltage is applied to the liquid prior to any liquid being projected away from the outlet means of the nozzle means.

8. A device as claimed in claim 1 in which the outlet of the nozzle means is at least 500 micron in diameter.

9. A device as claimed in claim 1 in which said electrode is generally annular and is so located that the angle between imaginary lines extending between the outlet of the nozzle means and diametrically opposite forward extremities of the annular electrode is in the range 140° to 195°.

10. A device as claimed in claim 9 in which said angle is between 150° and 180°.

11. A device as claimed in claim 1 further including electronic switching means associated with the high voltage output of the generator for controlling current and/or voltage switching operations of the device.

12. A device as claimed in claim 11 in which the switching means is operable to provide a current discharge path for capacitively stored charge in response to de-energisation of the high voltage generator.

13. A device as claimed in claim 12 in which the switching means is rendered operable automatically in response to operation of a user-actuable switch for de-energising the high voltage generator and discontinuing spraying.

14. A device as claimed in claim 13 in which the switching means is coupled to or forms part of the high voltage generator in such a way as to provide rectification.

15. A device as claimed in claim 11 in which said electronic switching means comprises a pair of radiation-responsive electronic switching elements and radiation-producing means arranged to control operation of the switching elements so as to produce a bipolar output voltage of predetermined frequency.

16. An electrostatic spraying device comprising a housing, nozzle means, means for supplying to the nozzle means material to be sprayed, high voltage generating circuitry having an output terminal via which high voltage is applied to said material to effect electrostatic spraying thereof an annular element of semi-insulating material encircling the nozzle means and electrically connected or connectible to said circuitry whereby a high voltage of the same and substantially the same magnitude as that applied to said material is established during spraying to attenuate the field intensity in the immediate vicinity of the nozzle outlet, and means operable upon cessation of spraying to discharge electrical charge stored by capacitive elements of the device during spraying.

17. A device as claimed in claim 16 including user-operable means for controlling activation and deactivation of the high voltage circuitry and in which said discharge means is operable automatically in response to deactivation of the high voltage circuitry.

18. A device as claimed in claim 17 in which said discharge means comprises electronic switching means.

19. A device as claimed in claim 18 in which said electronic switching means comprises a radiation-sensitive electronic switch and radiation-producing means for controlling operation of the electronic switch.

20. A device as claimed in claim 16 in which said annular element being so located that the angle between imaginary lines extending between the outlet of the nozzle means and diametrically opposite forward extremities of the annular element is in the range 140° to 195°.

21. A device as claimed in claim 16 in which said annular element being so located that the angle between imaginary lines extending between the outlet of the nozzle means and diametrically opposite forward extremities of the annular element is in the range 150° to 180°.

* * * * *